US010934955B2

(12) United States Patent
Pursifull et al.

(10) Patent No.: US 10,934,955 B2
(45) Date of Patent: Mar. 2, 2021

(54) METHOD AND SYSTEM FOR FUEL INJECTOR BALANCING

(71) Applicant: Ford Global Technologies, LLC, Dearborn, MI (US)

(72) Inventors: Ross Pursifull, Dearborn, MI (US); David Oshinsky, Trenton, MI (US); Paul Hollar, Belleville, MI (US); Joseph Thomas, Farmington Hills, MI (US); Michael Uhrich, Wixom, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 162 days.

(21) Appl. No.: 16/358,396

(22) Filed: Mar. 19, 2019

(65) Prior Publication Data

US 2020/0300189 A1 Sep. 24, 2020

(51) Int. Cl.

| | |
|---|---|
| ***F02D 41/30*** | (2006.01) |
| ***F02D 41/00*** | (2006.01) |
| ***F02M 59/10*** | (2006.01) |
| ***F02D 41/38*** | (2006.01) |
| ***F02M 65/00*** | (2006.01) |

(52) U.S. Cl.

CPC ..... *F02D 41/0085* (2013.01); *F02D 41/38* (2013.01); *F02M 59/102* (2013.01); *F02M 65/003* (2013.01); *F02D 2041/389* (2013.01); *F02D 2200/0604* (2013.01); *F02D 2250/04* (2013.01)

(58) Field of Classification Search

CPC .. F02D 41/0085; F02D 41/38; F02D 2250/04; F02D 2041/389; F02D 2200/0604; F02M 59/102; F02M 65/003

USPC ..... 123/456, 457, 481, 472, 479, 480, 497, 123/498, 499, 510, 511

See application file for complete search history.

(56) References Cited

U.S. PATENT DOCUMENTS

| | | | |
|---|---|---|---|
| 6,694,953 | B2 | 2/2004 | Barnes et al. |
| 7,523,743 | B1 | 4/2009 | Geveci et al. |
| 7,717,088 | B2 | 5/2010 | Thomas |
| 7,788,015 | B2 | 8/2010 | Geveci et al. |
| 9,593,637 | B2 | 3/2017 | Surnilla et al. |
| 2010/0269575 | A1 | 10/2010 | Cinpinski et al. |
| 2018/0328304 | A1 | 11/2018 | Pursifull et al. |

OTHER PUBLICATIONS

Surnilla, G. et al., "Method and System for Fuel Injector Balancing," U.S. Appl. No. 16/156,705, filed Oct. 10, 2018, 40 pages.
Pursifull, R. et al., "Method and System for Fuel Injector Balancing," U.S. Appl. No. 16/355,319, filed Mar. 15, 2019, 68 pages.
Pursifull, R. et al., "Method and System for Fuel Injector Balancing," U.S. Appl. No. 16/355,380, filed Mar. 15, 2019, 69 pages.

*Primary Examiner* — Hai H Huynh
(74) *Attorney, Agent, or Firm* — Geoffrey Brumbaugh; McCoy Russell LLP

(57) ABSTRACT

Methods and systems are provided for injector balancing without disabling a cam actuated high pressure fuel pump. In one example, one of a plurality of cam lobes of the pump is selectively and sequentially disabled while a group of injectors are concurrently operated to learn a pressure drop across each injector. The selection of the injectors is based on the identity and stroke timing of the disabled cam lobe.

20 Claims, 6 Drawing Sheets

METHOD AND SYSTEM FOR FUEL INJECTOR BALANCING

FIELD

The present description relates generally to methods and systems for calibrating a fuel injector of an engine so as to balance fuel delivery between all engine fuel injectors.

BACKGROUND/SUMMARY

Engines may be configured with direct fuel injectors (DI) for injecting fuel directly into an engine cylinder and/or port fuel injectors (PFI) for injecting fuel into an intake port of an engine cylinder. Fuel injectors often have piece-to-piece variability over time due to imperfect manufacturing processes and/or injector aging, for example. Over time, injector performance may degrade (e.g., injector becomes clogged) which may further increase piece-to-piece injector variability. As a result, the actual amount of fuel injected to each cylinder of an engine may not be the desired amount and the difference between the actual and desired amounts may vary between injectors. Variability in fuel injection amount between cylinders can result in reduced fuel economy, increased tailpipe emissions, torque variation that causes a lack of perceived engine smoothness, and an overall decrease in engine efficiency. Engines operating with a dual injector system, such as dual fuel or port fuel direct injection (PFDI) systems, may have even more fuel injectors (e.g., twice as many) resulting in greater possibility for injector variability.

Various approaches estimate injector performance by correlating a pressure drop across a fuel rail coupled to an injector with a fuel mass injected by the corresponding injector, also known as pressure base injector balancing (PBIB). One example approach is shown by Surnilla et al. in U.S. Pat. No. 9,593,637. Therein, a fuel injection amount for a direct injector is determined based on a difference in fuel rail pressure (FRP) measured before injector firing and FRP after injector firing. After learning individual injector errors, engine fueling is adjusted so as to bring all injector errors towards a common error, thereby balancing injector errors. To reduce confounding of FRP estimation results with other causes of pressure change, such as other direct injectors firing simultaneously, as well as pump strokes of a (cam actuated) high pressure direct injection fuel pump, the pump is disabled before injector firing is initiated.

However, the inventors herein have recognized potential issues with such systems. As one example, turning off the high pressure fuel pump before injector firing may result in a significant pressure drop before all engine injectors are able to fire at least once. For example, the pressure may drop below a threshold (at which the pump has to be re-enabled) before an engine controller is able to perform one complete cycle of injector balancing wherein each cylinder fuel injector is fired once. As a result, there may be a difference in average fuel rail pressure during the PBIB learning events across different injectors.

In one example, the issues described above may be addressed by a method comprising: selectively disabling one cam lobe of a camshaft driven fuel pump while maintaining remaining cam lobes enabled; operating a first set of direct fuel injectors with the one cam lobe disabled; and correlating pressure decrease at each injection event of the first set of injectors with corresponding injector operation. In this way, fuel rail pressure changes corresponding to a fuel injection event can be determined more reliably, allowing for improved injector balancing.

As one example, an engine fuel system may include a low pressure fuel lift pump and a cam actuated high pressure fuel pump (HPP). The HPP may be driven by a plurality of cam lobes based on the configuration of the engine, such as 2, 3, or more lobes. During engine fueling with the HPP enabled, a controller may selectively and sequentially disable a first cam lobe while remaining cam lobes continue to operate and generate pump strokes. Then, with the first cam lobe disabled, the controller may operate a first set of fuel injectors (which may include one or more fuel injectors) and sample FRP at a defined sampling rate over the course of the injection events at the first set of fuel injectors. Based on a pressure drop at each of the injection events, the controller may learn an injector error for each corresponding injector. The controller may then reactivate the first cam lobe while disabling a second cam lobe. With the second cam lobe disabled, the controller may operate a second set of fuel injectors (which may include one or more fuel injectors having an identity distinct from or partially overlapping the identity of the first set of fuel injectors) and sample FRP over the course of the injection events at the second set of fuel injectors, and thereby learn an injector error for each injector based on a pressure drop at corresponding injection events. The first set of injectors operated when the first cam lobe is disabled and the second set of injectors operated when the second cam lobe is disabled may be selected based on a map retrieved from the controller's memory, such as a map that was previously calibrated and that relates individual cylinder injection event timing to pump stroke event timing. In particular, the first set of injectors may include injectors having injection events that overlap with the pump stroke event of the first cam but not the second cam, such that disabling of the first cam removes the pressure pulse effect of the first cam during PBIB learning for the first set of injectors. Likewise, the second set of injectors may include injectors having injection events that overlap with the pump stroke event of the second cam but not the first cam, such that disabling of the second cam removes the pressure pulse effect of the second cam during PBIB learning for the second set of injectors In this way, by adjusting a combination of cam lobes that are disabled and injectors operated while a given cam lobe is disabled, an injector error for all engine injectors may be learned, and the injectors may be balanced in accordance. The technical effect of learning a pressure drop for an injection event at an injector with a cam lobe of a high pressure fuel pump selectively disabled is that an inter-injection average FRP measurement can be made for the injector without confounding the results due to pressure pulsations from overlapping pump stroke events. Further, multiple PBIB learning events may be scheduled in a shorter time, improving FRP maintenance. This allows errors for all injectors to be learned without requiring the high pressure fuel pump to be disabled for an entire engine cycle over which each injector fires at least once. By selectively disabling only one cam lobe at a time, FRP is better maintained, reducing variation in injector error learning due to FRP variations. By learning injector errors for all engine fuel injectors with higher reliability, balancing of the injectors is improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
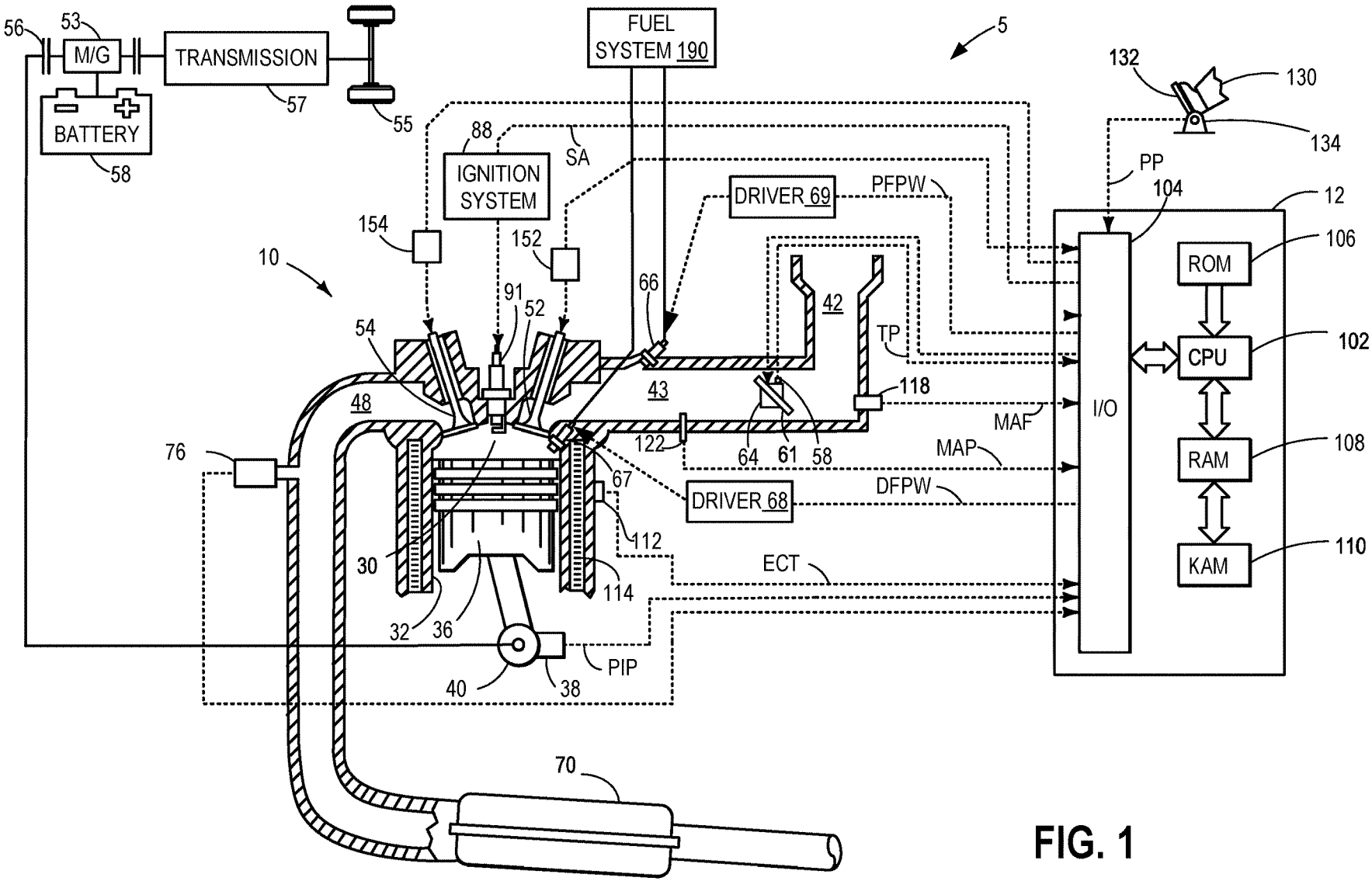
FIG. 1 shows a schematic depiction of an example propulsion system including an engine.
Figure 2:
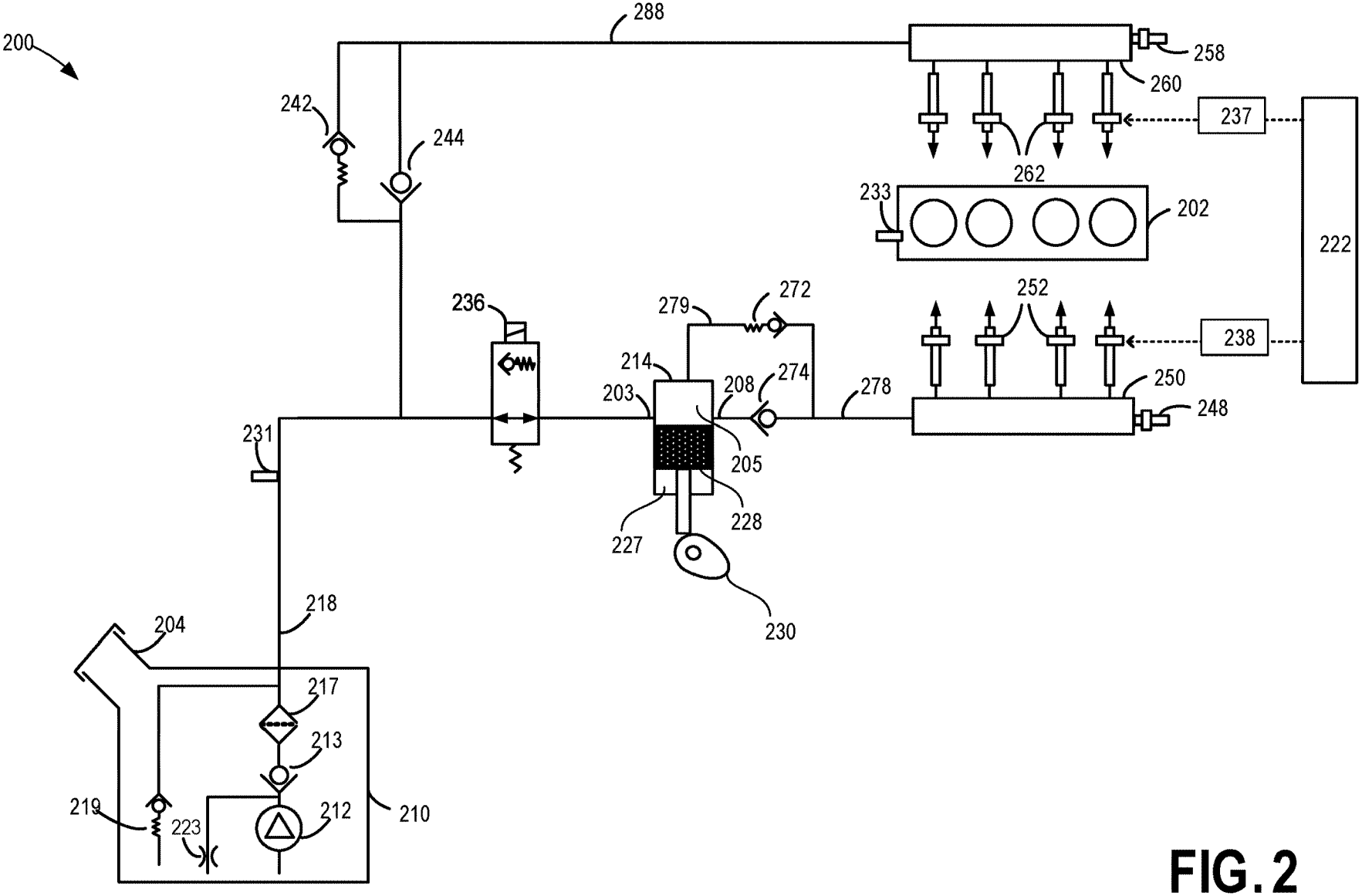
FIG. 2 shows an example fuel system coupled to the engine of FIG. 1.

The following description relates to systems and methods for calibrating fuel injectors in an engine, such as the fuel system of FIG. 2 coupled in the propulsion system of FIG. 1. The fuel injectors may be direct and/or port fuel injectors. A controller may be configured to perform a control routine, such as the example routine of FIG. 3, to selectively disable one of a plurality of cam lobes of a high pressure fuel pump, while remaining lobes remain enabled, and operate a group of injectors. A selection of a cam lobe to disable and injectors to operate is performed in accordance with the routine of FIG. 4. The controller may then learn a fuel rail pressure drop for the injectors on corresponding injection events. The controller may refer to a map, such as the example map of FIG. 6, to select the group of injectors that are operated while the given cam lobe is disabled. The controller may sequentially disable each cam lobe, and assess a different set of fuel injectors based on which lobe is disabled, until all injectors have had at least one injection event for learning injector balancing. The controller may correlate a fuel pressure drop at each injection event with a volume of injection (FIG. 5) to learn individual injector errors. Injector commands are subsequently adjusted to balance injector errors. A prophetic example of PBIB learning for injector balancing is shown at FIG. 7.

FIG. 1 shows a schematic depiction of a spark ignition internal combustion engine 10 with a dual injector system, where engine 10 is configured with both direct and port fuel injection. Engine 10 may be included in a vehicle 5. Engine 10 comprises a plurality of cylinders of which one cylinder 30 (also known as combustion chamber 30) is shown in FIG. 1. Cylinder 30 of engine 10 is shown including combustion chamber walls 32 with piston 36 positioned therein and connected to crankshaft 40. A starter motor (not shown) may be coupled to crankshaft 40 via a flywheel (not shown), or alternatively, direct engine starting may be used.

Combustion chamber 30 is shown communicating with intake manifold 43 and exhaust manifold 48 via intake valve 52 and exhaust valve 54, respectively. In addition, intake manifold 43 is shown with throttle 64 which adjusts a position of throttle plate 61 to control airflow from intake passage 42.

Intake valve 52 may be operated by controller 12 via actuator 152. Similarly, exhaust valve 54 may be activated by controller 12 via actuator 154. During some conditions, controller 12 may vary the signals provided to actuators 152 and 154 to control the opening and closing of the respective intake and exhaust valves. The position of intake valve 52 and exhaust valve 54 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation and an exhaust valve controlled via cam actuation including CPS and/or VCT. In other embodiments, the intake and exhaust valves may be controlled by a common valve actuator or actuation system, or a variable valve timing actuator or actuation system.

In another embodiment, four valves per cylinder may be used. In still another example, two intake valves and one exhaust valve per cylinder may be used.

Combustion chamber 30 can have a compression ratio, which is the ratio of volumes when piston 36 is at bottom center to top center. In one example, the compression ratio may be approximately 9:1. However, in some examples where different fuels are used, the compression ratio may be increased. For example, it may be between 10:1 and 11:1 or 11:1 and 12:1, or greater.

In some embodiments, each cylinder of engine 10 may be configured with one or more fuel injectors for providing fuel thereto. As shown in FIG. 1, cylinder 30 includes two fuel injectors, 66 and 67. Fuel injector 67 is shown directly coupled to combustion chamber 30 for delivering injected fuel directly therein in proportion to the pulse width of signal DFPW received from controller 12 via electronic driver 68. In this manner, direct fuel injector 67 provides what is known as direct injection (hereafter referred to as "DI") of fuel into combustion chamber 30. While FIG. 1 shows injector 67 as a side injector, it may also be located overhead of the piston, such as near the position of spark plug 91. Such a position may improve mixing and combustion due to the lower volatility of some alcohol based fuels. Alternatively, the injector may be located overhead and near the intake valve to improve mixing.

Fuel injector 66 is shown arranged in intake manifold 43 in a configuration that provides what is known as port injection of fuel (hereafter referred to as "PFI") into the intake port upstream of cylinder 30 rather than directly into cylinder 30. Port fuel injector 66 delivers injected fuel in proportion to the pulse width of signal PFPW received from controller 12 via electronic driver 69.

Fuel may be delivered to fuel injectors 66 and 67 by a high pressure fuel system 190 including a fuel tank, fuel pumps, and fuel rails. Further, the fuel tank and rails may each have a pressure transducer providing a signal to controller 12. An example fuel system including fuel pumps and injectors and fuel rails is elaborated with reference to FIG. 2.

Exhaust gases flow through exhaust manifold 48 into emission control device 70 which can include multiple catalyst bricks, in one example. In another example, multiple emission control devices, each with multiple bricks, can be used. Emission control device 70 can be a three-way type catalyst in one example.

Exhaust gas sensor 76 is shown coupled to exhaust manifold 48 upstream of emission control device 70 (where sensor 76 can correspond to a variety of different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. In this particular example, sensor 76 is a two-state oxygen sensor that provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS may be used to advantage during feedback air/fuel control to maintain average air/fuel at stoichiometry during a stoichiometric homogeneous mode of operation. A single exhaust gas sensor may serve 1, 2, 3, 4, 5, or other number of cylinders.

Distributorless ignition system 88 provides ignition spark to combustion chamber 30 via spark plug 91 in response to spark advance signal SA from controller 12.

Controller 12 may cause combustion chamber 30 to operate in a variety of combustion modes, including a homogeneous air/fuel mode and a stratified air/fuel mode by controlling injection timing, injection amounts, spray patterns, etc. Further, combined stratified and homogenous mixtures may be formed in the chamber. In one example, stratified layers may be formed by operating injector 66 during a compression stroke. In another example, a homogenous mixture may be formed by operating one or both of injectors 66 and 67 during an intake stroke (which may be open valve injection). In yet another example, a homogenous mixture may be formed by operating one or both of injectors 66 and 67 before an intake stroke (which may be closed valve injection). In still other examples, multiple injections from one or both of injectors 66 and 67 may be used during one or more strokes (e.g., intake, compression, exhaust, etc.). Even further examples may be where different injection timings and mixture formations are used under different conditions, as described below.

Controller 12 can control the amount of fuel delivered by fuel injectors 66 and 67 so that the homogeneous, stratified, or combined homogenous/stratified air/fuel mixture in chamber 30 can be selected to be at stoichiometry, a value rich of stoichiometry, or a value lean of stoichiometry.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time. Further, in the disclosed embodiments, an exhaust gas recirculation (ERG) system may be used to route a desired portion of exhaust gas from exhaust manifold 48 to intake manifold 43 via an EGR valve (not shown). Alternatively, a portion of combustion gases may be retained in the combustion chambers by controlling exhaust valve timing.

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 53. Electric machine 53 may be a motor or a motor/generator. Crankshaft 140 of engine 10 and electric machine 53 are connected via a transmission 57 to vehicle wheels 55 when one or more clutches 56 are engaged. In the depicted example, a first clutch 56 is provided between crankshaft 140 and electric machine 53, and a second clutch 56 is provided between electric machine 53 and transmission 57. Controller 12 may send a signal to an actuator of each clutch 56 to engage or disengage the clutch, so as to connect or disconnect crankshaft 140 from electric machine 53 and the components connected thereto, and/or connect or disconnect electric machine 53 from transmission 57 and the components connected thereto. Transmission 54 may be a gearbox, a planetary gear system, or another type of transmission. The powertrain may be configured in various manners including as a parallel, a series, or a series-parallel hybrid vehicle.

Electric machine 53 receives electrical power from a traction battery 58 to provide torque to vehicle wheels 55. Electric machine 53 may also be operated as a generator to provide electrical power to charge battery 58, for example during a braking operation.

Controller 12 is shown in FIG. 1 as a conventional microcomputer including: central processing unit (CPU) 102, input/output (I/O) ports 104, read-only memory (ROM) 106, random access memory (RAM) 108, keep alive memory (KAM) 110, and a conventional data bus. Controller 12 is shown receiving various signals from sensors coupled to engine 10, in addition to those signals previously discussed, including measurement of inducted mass air flow (MAF) from mass air flow sensor 118; engine coolant temperature (ECT) from temperature sensor 112 coupled to cooling sleeve 114; a profile ignition pickup signal (PIP) from Hall effect sensor 38 coupled to crankshaft 40; and throttle position TP from throttle position sensor 58 and an absolute Manifold Pressure Signal MAP from sensor 122. Engine speed signal RPM is generated by controller 12 from signal PIP in a conventional manner and manifold pressure signal MAP from a manifold pressure sensor provides an indication of vacuum, or pressure, in the intake manifold. During stoichiometric operation, this sensor can give an indication of engine load. Further, this sensor, along with engine speed, can provide an estimate of charge (including air) inducted into the cylinder. In one example, sensor 38, which is also used as an engine speed sensor, produces a predetermined number of equally spaced pulses every revolution of the crankshaft. The controller 12 receives signals from the various sensors of FIG. 1 and employs the various actuators of FIG. 1, such as throttle 61, fuel injectors 66 and 67, spark plug 91, etc., to adjust engine operation based on the received signals and instructions stored on a memory of the controller. As one example, the controller may send a pulse width signal to the port injector and/or the direct injector to adjust an amount of fuel delivered to a cylinder.

FIG. 2 schematically depicts an example embodiment 200 of a fuel system, such as fuel system 190 of FIG. 1. Fuel system 200 may be operated to deliver fuel to an engine, such as engine 10 of FIG. 1. Fuel system 200 may be operated by a controller to perform some or all of the operations described with reference to the methods of FIG. 3.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at orifice 223 may also be used to power a jet pump used to transfer fuel from one location to another within the tank 210. In one example, an orifice check valve (not shown) may be placed in series with orifice 223. In some embodiments, fuel system 8 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a first injector group). Fuel lifted by the LPP 212 may also be supplied to a second fuel rail 260 coupled to one or more fuel injectors of a second group of port injectors 262 (herein also referred to as a second injector group). HPP 214 may be operated to raise the pressure of fuel delivered to the first fuel rail above the lift pump pressure, with the first fuel rail coupled to the direct injector group operating with a high pressure. As a result, high pressure DI may be enabled while PFI may be operated at a lower pressure.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

HPP 214 may be an engine-driven, positive-displacement pump. As one non-limiting example, HPP 214 may be a Bosch HDPS high pressure pump, which utilizes a solenoid activated control valve 236 (e.g., fuel volume regulator, magnetic solenoid valve, etc.) to vary the effective pump volume of each pump stroke. The outlet check valve 236 of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

In one example, the DI pump cam may be placed on the engine's exhaust cam (that is the cam used for controlling exhaust valve timing). Thus in some embodiments, the controller may consider the angle timing of the exhaust stroke when disabling a DI pump lobe. However, it may be that since the exhaust cam angular adjustment is small in range (e.g. 40°) that this is a minor consideration.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. A check valve 274 and a pressure relief valve (also known as pump relief valve) 272 may be positioned between the outlet 208 of the HPP 214 and the first (DI) fuel rail 250. The pump relief valve 272 may be coupled to a bypass passage 279 of the fuel passage 278. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. The pump relief valve 272 may limit the pressure in fuel passage 278, downstream of HPP 214 and upstream of first fuel rail 250. For example, pump relief valve 272 may limit the pressure in fuel passage 278 to 200 bar. Pump relief valve 272 allows fuel flow out of the DI fuel rail 250 toward pump outlet 208 when the fuel rail pressure is greater than a predetermined pressure. Valves 244 and 242 work in conjunction to keep the low pressure fuel rail 260 pressurized to a pre-determined low pressure. Pressure relief valve 242 helps limit the pressure that can build in fuel rail 260 due to thermal expansion of fuel.

Controller 222 may be configured to regulate fuel flow into HPP 214 through control valve 236 by energizing or de-energizing the solenoid valve (based on the solenoid valve configuration) in synchronism with the driving cam. Accordingly, the solenoid activated control valve 236 may be operated in a first mode where the valve 236 is positioned within HPP inlet 203 to limit (e.g. inhibit) the amount of fuel traveling through the solenoid activated control valve 236. Depending on the timing of the solenoid valve actuation, the volume transferred to the fuel rail 250 is varied. The solenoid valve may also be operated in a second mode where the solenoid activated control valve 236 is effectively disabled and fuel can travel upstream and downstream of the valve, and in and out of HPP 214.

As such, solenoid activated control valve 236 may be configured to regulate the mass (or volume) of fuel compressed into the direct injection fuel pump. In one example, controller 222 may adjust a closing timing of the solenoid pressure control check valve to regulate the mass of fuel compressed. For example, a late pressure control valve closing may reduce the amount of fuel mass ingested into compression chamber 205. The solenoid activated check valve opening and closing timings may be coordinated with respect to stroke timings of the direct injection fuel pump. The inlet check valve 236 is in place when the solenoid is powered. When the inlet check valve 236 is selected (via powering the solenoid) the pump will pump on its compression stroke. Pressure relief valve 232 allows fuel flow out of solenoid activated control valve 236 toward the LPP 212 when pressure between pressure relief valve 232 and solenoid operated control valve 236 is greater than a predetermined pressure (e.g., 10 bar). When solenoid operated control valve 236 is deactivated (e.g., not electrically energized), solenoid operated control valve operates in a pass-through mode and pressure relief valve 232 regulates pressure in compression chamber 205 to the single pressure relief set-point of pressure relief valve 232 (e.g., 10 bar above the pressure at sensor 231). Regulating the pressure in compression chamber 205 allows a pressure differential to form from the piston top to the piston bottom. The pressure in step-room 227 is at the pressure of the outlet of the low pressure pump (e.g., 5 bar) while the pressure at piston top is at pressure relief valve regulation pressure (e.g., 15 bar). The pressure differential allows fuel to seep from the piston top to the piston bottom through the clearance between the piston and the pump cylinder wall, thereby lubricating HPP 214. When the solenoid controlled valve 236 is in the powered position, flow is checked.

The number of strokes of the cam lobe 230, and accordingly, the number of engine cyclic pressure patterns applied by the cam lobe on the DI fuel rail pressure, as well as the pressure increase resulting from the pattern, may be a function of the configuration of the cam lobe. For example, cams with three lobes may generate three evenly-spaced throws or lifts, while cams with lobes may generate 4 evenly spaced throws or lifts, and a cam with five lobes may generate five evenly spaced throws or lifts with a 720° cycle of their motion. Further, the fuel flow with a four lobed cam may be higher than with a three-lobed or a five-lobed cam.

Based on engine operating conditions, fuel may be delivered by one or more port injectors 262 and direct injectors 252. For example, during high load conditions, fuel may be delivered to a cylinder on a given engine cycle via only direct injection, wherein port injectors 262 are disabled. In another example, during mid-load conditions, fuel may be delivered to a cylinder on a given engine cycle via each of direct and port injection. As still another example, during low load conditions, engine starts, as well as warm idling conditions, fuel may be delivered to a cylinder on a given engine cycle via only port injection, wherein direct injectors 252 are disabled.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Controller 12 can also control the operation of each of fuel pumps 212, and 214 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed, flow output, and/or pressure) of the low pressure pump.

The fuel injectors may have injector-to-injector variability due to manufacturing, as well as due to age. Ideally, for improved fuel economy, it is desirable for every cylinder to have matching fuel injection amounts for matching fuel delivery commands. By balancing air and fuel injection into all cylinders, engine performance is improved. In particular, fuel balancing improves exhaust emission control via effects on exhaust catalyst operation. In addition, fuel balancing improves fuel economy because fueling richer or leaner than desired reduces fuel economy and results in an inappropriate ignition timing for the actual relative fuel-air ratio. Thus, getting to the intended relative fuel-air ratio has both a primary and secondary effect on maximizing cylinder energy for fuel investment.

Injector errors may be learned and addressed by a method known as pressure based injector balancing (PBIB) wherein a pressure drop associated with an injection event is learned by comparing fuel rail pressure before and after the injection event, while a fuel pump is disabled. A fuel mass actually delivered during the injection event, estimated based on the pressure drop, is compared to the fuel mass intended to be delivered, inferred based on a pulse-width commanded to the injector. By learning individual injector errors and then adjusting overall engine fueling, each injector can be brought towards a common (e.g., average) error, improving an engine's torque evenness.

During PBIB learning, it is desirable for the fuel rail pressure to remain stable. To separate the effect of other fuel rail pressure altering events during a given PBIB learning event at an injector (such as interference from other injectors firing simultaneously and/or pump stroke events), the high pressure fuel pump is disabled. If the pump were not disabled, the action of each cam lobe stroke of the pump would add a cyclic pressure pattern to the fuel rail pressure. The controller would, ideally, need to perform one complete "cycle" of PBIB learning, wherein each injector is fired once (e.g., over 720° crank angle degrees, CAD) and an associated pressure drop is learned, before the pump is re-enabled. However, the pressure drop associated with disabling the pump may be large enough to require the pump to be re-enabled before the "cycle" of PBIB learning is completed. The pump is then operated to raise the fuel rail pressure, and then disabled again to complete the PBIB learning. As a result, the average fuel rail pressure at the time of PBIB learning at a first injector on a first cycle (where the pump is disabled) may vary from the average fuel rail pressure at the time of PBIB learning at a second injector (or even the same first injector) on a second cycle wherein the pump has been operated to raise pressure in between the two cycles. This can result in unintended errors in PBIB learning and less than optimal injector balancing.

All known DI pump cams are "even lifting". They equally space cam lifts over their 720° of motion. Some engine configurations may drive the cam at crankshaft speed instead of camshaft speed, but that does not affect the pattern of fuel pressure rises that show up in the direct injection fuel rail. Therefore, if the DI pump's solenoid valve is deactivated during a pump stroke, inter-injection fuel rail pressure measurements can be completed during a PBIB routine without interference.

Figure 3:
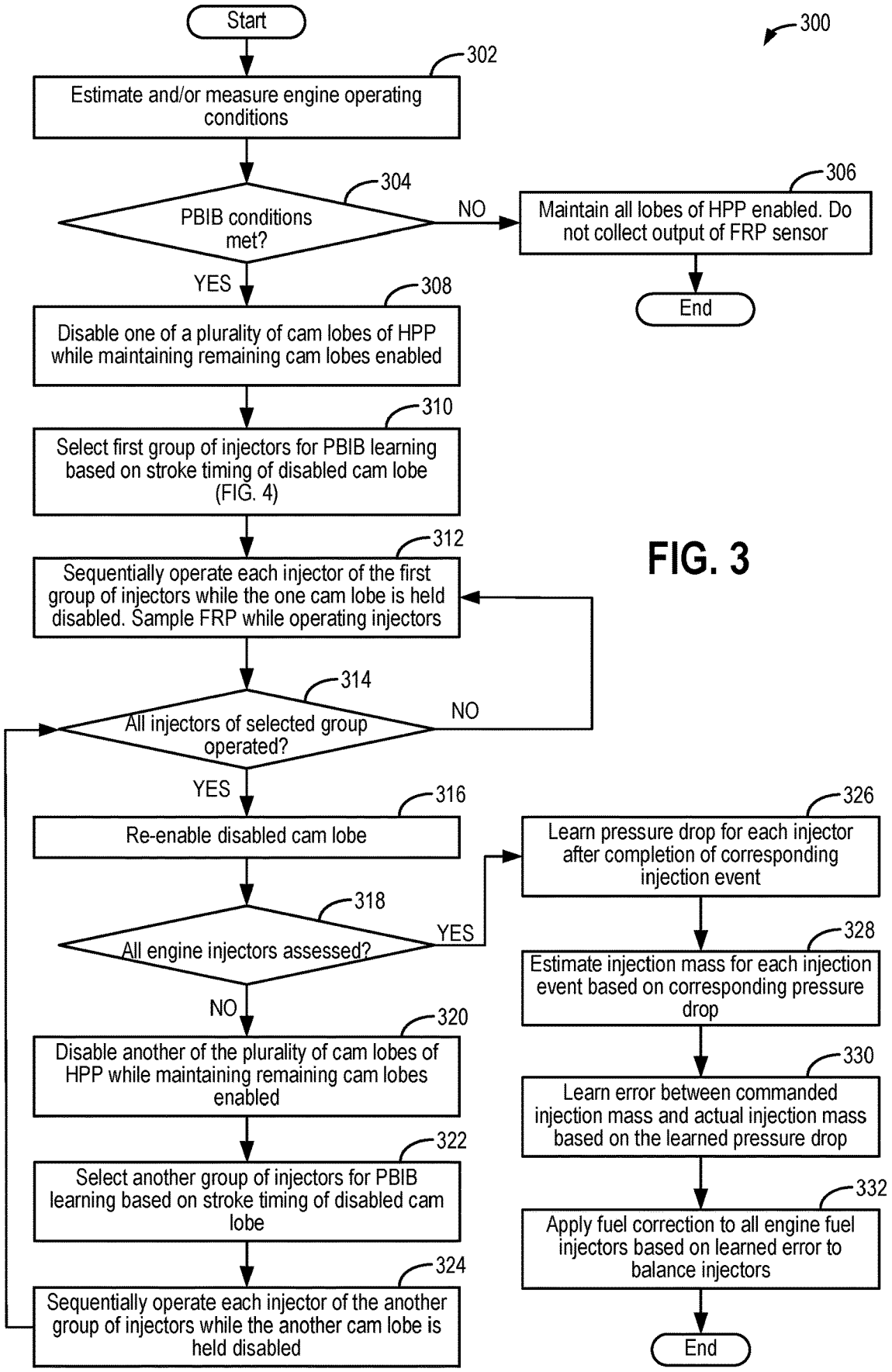
FIG. 3 shows a high level flow chart of an example method for learning individual injector errors based on fuel rail pressure sampled while one of a plurality of fuel pump cam lobes is selectively disabled.

As elaborated herein with reference to FIG. 3, fuel rail pressure may be better maintained during a PBIB learning routine by selectively disabling only one cam lobe of a multi-lobed high pressure fuel pump, and operating a group of injectors to learn an associated pressure drop. The group of injectors are selected based on the cam lobe that is disabled. By disabling the cam lobe whose pump stroke coincides with the injection event at the selected group of injectors, the fuel rail pressure rise associated with the operation of that cam lobe is prevented from interfering with the PBIB learning at the selected group of injectors. The controller may refer to a map, customized for the configuration of each engine and its associated fuel system, such as the example map of FIG. 4, to identify overlapping injection and pump stroke events. By varying the identity of the cam lobe that is selectively disabled and the group of injectors that are selectively operated while a given cam lobe is disabled, fuel rail pressure can be maintained without having to fully disable a high pressure fuel pump and while balancing errors are learned for each individual fuel injector.

By disabling one or more lobes at a time, the DI pump pulse "gets out of the way" to do PBIB on different injectors while maintaining fuel rail pressure much closer to target fuel rail pressure. While the lobe can be disabled in multiple ways, one example way includes not powering the DI pump's solenoid valve during its pump stroke, which results in no fuel being pump into the DI fuel rail. This allows for a full inter-injection period before and after an injection to be captured so as to determine the pressure drop due to that injection over the course of a PBIB routine. A reliable and accurate inter-injection FRP reading is obtained by disabling the DI pump lobe (pumping event) that would otherwise interfere (or appear) within these inter-injection periods.

Turning now to FIG. 3, an example method for accurately learning individual injector errors via a pressure drop based injector balancing method is shown at 300. The method enables fuel rail pressures to be maintained during the learning by selectively disabling only one cam lobe of a multi cam actuated high pressure fuel pump. The method selects a group of injectors to be operated for learning an injection volume dispensed by each fuel injector on a given fuel injection event based on the identity and stroke timing (relative to injection timing) of the disabled cam lobe. Instructions for carrying out method 300 may be executed by a controller based on instructions stored on a memory of the controller and in conjunction with signals received from sensors of the engine system, such as the sensors described above with reference to FIGS. 1-2. The controller may employ engine actuators of the engine system to adjust engine operation, according to the methods described below.

At 302, the method includes estimating and/or measuring engine operating conditions. These include, for example, engine speed, torque demand, manifold pressure, manifold air flow, ambient conditions (ambient temperature, pressure, and humidity, for example), engine dilution, etc.

At 304, it may be determined if pressure based injector balancing (PBIB) conditions are met. Alternatively, it may be determined if injector calibration conditions are met. If PBIB conditions are met, then PBIB learning can be started. PBIB conditions may be considered met if a threshold duration and/or distance of vehicle operation has elapsed since a last calibration of the engine's fuel injectors. As another example, PBIB conditions are considered met if the engine is operating fueled with fuel being delivered to engine cylinders via a direct fuel injector. For example, any time the direct injectors are in use, the fuel rails may be sampled, and the injectors can be calibrated and balanced for that condition. While the injector calibration and fuel rail pressure sampling conditions are defined as a function of fuel injection pulse width and FRP, it will be appreciated that other variables could be chosen. If PBIB conditions are not met, then at 306, the method includes not collecting the output of a fuel rail pressure sensor coupled to a direct and/or a port injection fuel rail. The method then ends.

At 308, responsive to PBIB conditions being met, one of the plurality of cam lobes of a cam actuated high pressure direct injection fuel pump (HPP) of the engine's fuel system is disabled. The cam lobe selected for deactivation may be based on a stroke timing of the cam lobe relative to a timing of initiating the PBIB learning. For example, the cam lobe that is scheduled to operate first after the PBIB conditions are met may be selected for deactivation. Each lobe gets a little time off and it allows certain injectors to be tested as it "gets out of the way". Therefore the pump pulse has to be out of both the pre and post inter-injection periods so as to make a valid measurement of pressure drop due to injection alone. While the selected cam lobe is disabled, the remaining cam lobes of the HPP continue to operate and generate pump strokes at the scheduled timing. Disabling a selected cam lobe may include disabling the cam lobe mechanically, such as by collapsing a rocker arm coupled to the cam lobe. Alternatively, the cam lobe may be disabled electrically by disabling energization of an associated direct injection fuel pump solenoid valve.

At 310, the method includes selecting a first group of fuel injectors to be operated for PBIB learning. The first group of injectors may be indexed by cylinder number and are selected based on the stroke timing of the disabled cam lobe. As elaborated at FIG. 4, the controller may identify injectors corresponding to cylinders during whose injection events the fuel rail pressure may have pressure interference due to a pump stroke of the cam lobe that is disabled. In particular, if the pump stroke of the disabled cam lobe would have appeared in the inter-injection period between two (or more) consecutive injection events, then the PBIB learning of those injectors would have been affected. Therefore, those injectors and the corresponding cylinders are selected for operation. As used herein, the pump stroke appearing in an inter-injection period of two immediately consecutive injection events includes the pump stroke appearing in a defined pre- and post-injection period of any of those injection events, wherein the pre- and post-injection period includes a region where fuel rail pressure is sampled for injector error learning via a PBIB routine. The controller may refer to a map, such as map 600 of FIG. 6, wherein the injection timing of each cylinder injector, inter-injection periods, and the pump stroke timing of each cam lobe of the HPP is mapped and indexed with reference to engine position.

At 312, the method includes sequentially operating each injector of the selected first group of injectors while the selected one cam lobe is held disabled. The selected injectors are operated in accordance with their firing order. Operating the selected injectors may include commanding a duty cycle pulse-width corresponding to a desired fuel mass to be delivered to the cylinder. The desired fuel mass may be a function of the engine torque requested by an operator at the time of the PBIB learning.

In another example, the controller may operate all injectors while turning off one pump lobe at a time. That said, as the injection on angles take up more of the 720° angular space, the controller either needs to suspend PBIB, reduce the injection pulse width, increase the FRP (thus reducing the injection pulse width), or use fewer DI injectors (such as by operating every other one). This may include shifting more of the fueling task to the PFI injection system.

While sequentially operating the selected group of injectors, the method further includes sampling fuel rail pressure (FRP) at a defined sampling rate. In one example, FRP is continuously sampled during the injector calibration operation at a defined sampling rate, such as 1 sample every 1 millisecond. Samples may be indexed in terms of injection event number, as well as engine position. The fuel rail pressure sampled may include a port injection fuel rail pressure when the injection event is a port injection event, or a direct injection fuel rail pressure when the injection event is a direct injection event. In one example, fuel rail pressure is sampled at a 1 kHz frequency. For example, the fuel rail pressure may be sampled at a low data rate of once every 1 millisecond period (that is, a 1 millisecond period, 12 bit pressure sample). In still other examples, the fuel rail pressure may be sampled at a high speed, such as a 10 kHz (that is, a 0.1 millisecond period), however the higher sampling rate may not be economical. As a result of the sampling, a plurality of pressure samples are collected for each injection event from each injector of the selected group of injectors, in the order of cylinder firing. Herein, each injection event is defined as a period starting from just before injector opening, and ending just before the opening of another injector on a subsequent injection event. The pressure signal may improve as the number of firing cylinders decreases. As elaborated below, the controller may learn a pressure drop associated with each injection event performed at the selected group of injectors.

At 314, the method includes confirming if all injectors of the selected group have been operated. For example, it may be confirmed that each injector of the selected group has fired at least once. If yes, then at 316, the disabled cam lobe is reactivated. Else, the method returns to 312 to operate remaining injectors of the selected group.

After enabling the disabled cam lobe at 316, the method moves to 318, to determine if all engine injectors have been assessed. For example, it may be confirmed if each engine injector has operated at least once while a cam lobe was held disabled. If not, such as may occur when only a subset of the injectors included in the first group have been operated, the method moves to 320 to select another cam lobe for disablement. The controller may select a second cam lobe that is the immediately next cam lobe of the HPP to operate after the first cam lobe completes operation. Accordingly, the controller may disable the second cam lobe while maintaining the first cam lobe enabled and any other remaining cam lobes of the HPP enabled.

Then at 322, the controller may select another group of injectors, such as a second group, for PBIB learning. The second group of injectors may be selected based on the identity and pump stroke timing of the second cam lobe that was disabled. For example, the second group of injectors may have injection timings that could have interference from a pump stroke if the second cam lobe was not disabled. The second group of injectors may be non-overlapping with the first group of injectors.

As such, if the injection pulses of the second group of injectors overlaps with the first group of injectors, PBIB based injector error learning (which is based on a pressure captured during an inter-injection period) may not be possible. Thus, the controller may either suspend PBIB or perform an action to remove overlap. Overlap may be reduced/eliminated by one or more of increasing FRP, lowering engine speed, and temporarily shifting fueling to PFI.

At 324, as at 312, the method includes sequentially operating each injector of the selected second group of injectors while the selected second cam lobe is held disabled. The selected injectors are operated in accordance with their firing order. Operating the selected injectors may include commanding a duty cycle pulse-width corresponding to a desired fuel mass to be delivered to the cylinder. The desired fuel mass may be a function of the engine torque requested by an operator at the time of the PBIB learning. While operating the injectors, fuel rail pressure may be sampled via a fuel rail pressure sensor at a defined sampling rate, as detailed earlier. The controller may then learn a pressure drop associated with each injection event performed at the selected group of injectors. The controller may learn a pressure drop associated with each injection event performed at the selected group of injectors. The method then returns to 314 to confirm if all injectors of the selected group have been operated. For example, it may be confirmed that each injector of the selected group has fired at least once, the disabled cam lobe is reactivated. The method then proceeds to 318 to confirm that all injectors have been assessed by sequentially disabling one cam lobe at a time. If not, the method reiterates until each cam lobe has been disabled once over an engine cycle (such as over 720° CAD of rotation) and a group of injectors have been operated with a given cam lobe disabled.

After sequentially disabling each cam lobe and operating distinct groups of fuel injectors with a given cam lobe disabled, the method moves to 326 to retrieve a pressure drop for each fuel injector. After completion of each injection event (with one of a plurality of cam lobes disabled), the controller may monitor a decrease in fuel rail pressure from before the corresponding injection event. A pressure drop may be learned, indexed as function of the injector and the corresponding cylinder identity. This may include comparing an average fuel rail pressure (FRP) sensed or inferred before a given injection event with the FRP sensed upon completion of the injection event. Alternatively, the controller may compare the average FRP estimated for injection n relative to the average pressure estimated for an immediately preceding injection event (n−1), with no intermediate injection events.

At 328, the method includes estimating the actual fuel mass dispensed at a given injection event n based on the learned pressure drop. In one example, a map correlating pressure drop with injection mass, such as map 500 of FIG. 5, may be used for estimating the dispensed fuel mass. In the depicted example (map 500), there is a linear relation 502 between drop in fuel rail pressure over an injection event and the fuel mass dispensed by an injector during that injection event. In other examples, a model, transfer function, look-up table, or algorithm may be used to learn the dispensed fuel mass based on the pressure drop. The actual mass injected is further based on the bulk modulus of the fuel, the fuel density, and the fuel rail volume. In one example, the actual mass injected is determined as per equation (1):

$$\text{Actual mass injected} = (\text{Delta}P/\text{bulk modulus}) * \text{fuel rail volume} * \text{fuel density} \quad (1)$$

At 330, the method includes computing an injector error between the intended injection mass that was commanded (based on the commanded duty cycle pulse width and average FRP at the time of the injection event) and the actual injection mass as computed from the pressure difference. The computed difference in fuel mass is the injector error that needs to be compensated for in future injections to balance injectors. Specifically, a fuel mass error for the given injector is computed as a difference between the commanded fuel mass (determined based on commanded pulse-width) and the actual fuel mass (determined based on the measured delta pressure). The fuel mass error for the given injector is then compared to the corresponding fuel mass error for other cylinders, or an average fuel mass error for all engine cylinder injectors. For example, the fuel mass error for a first port or direct fuel injector via which fuel is dispensed into a first cylinder during injection_n is compared to a fuel mass error for corresponding port or direct fuel injectors via which fuel is dispensed into each of the remaining engine cylinders over a single engine cycle (where each cylinder is fueled once over the cycle). Based on the differences in fuel mass error between the injectors, a degree of balancing required between injectors is determined. The corrections across all injectors are computed, averaged, and then the average is subtracted from the individual injector corrections to learn the remaining injector-to-injector corrections needed to balance the injectors without affecting the average fueling across the cylinders. In this way, the relative errors between fuel injectors is learned and corrected for via a pressure based injector balancing (PBIB) approach.

At 332, the method includes applying a fuel correction to each fuel injector based on the corresponding learned error to balance errors between injectors. More particularly, a fuel correction is applied to all engine fuel injectors so that all injectors have a common average error. For example, a transfer function of each fuel injector may be updated based on the learned fuel mass error for each injector and an average fuel injector error to reduce the variability in fuel mass injected by each injector for a given pulse width command. The controller may learn a fuel mass error of a given fuel injector based on a sensed change in fuel rail pressure after commanding the pulse-width, and adjust a transfer function of the fuel injector during a subsequent fueling event at the same injector to bring the learned fuel mass error towards a common fuel mass error across all engine fuel injectors. The method then ends.

It will be appreciated the errors are not corrected in one single measurement as there may be noise in the measurement. Thus, the controller aims to correct the average error, instead of trying to respond to the system noise. In one example, this is done by making a percent of the requisite correction at each pass, e.g. 20% on the first pass and then taking another measurement and making another 20% correction on the second pass, and so on. In this way, the corrections will result in the average error converging toward zero.

For example, if the controller commanded an injection of 8.000 mg to injector_n based on the average FRP (estimated via the moving window or quiet region approach) and from the pressure drop following the injection event at injector_n, an actual injection mass of 8.200 mg was determined, then the controller may learn that the given fuel injector over-fueled by 0.200 mg. To balance the errors for all injectors, a similar error is determined for each injector and averaged. The 0.200 mg error of injector_n is compared to the average error. For example, if the average error is computed to be 0.180 mg, then the fueling of each injector is adjusted to bring the injector error (for each injector of the engine) to the average error. In this case, the command to injector_n is adjusted to account for a 0.020 mg surplus. As such, adjusting the injector error to balance the injectors is different from adjusting the error to correct for it. To correct for the error, the injector command would have been adjusted to account for a 0.200 mg surplus.

Figure 4:
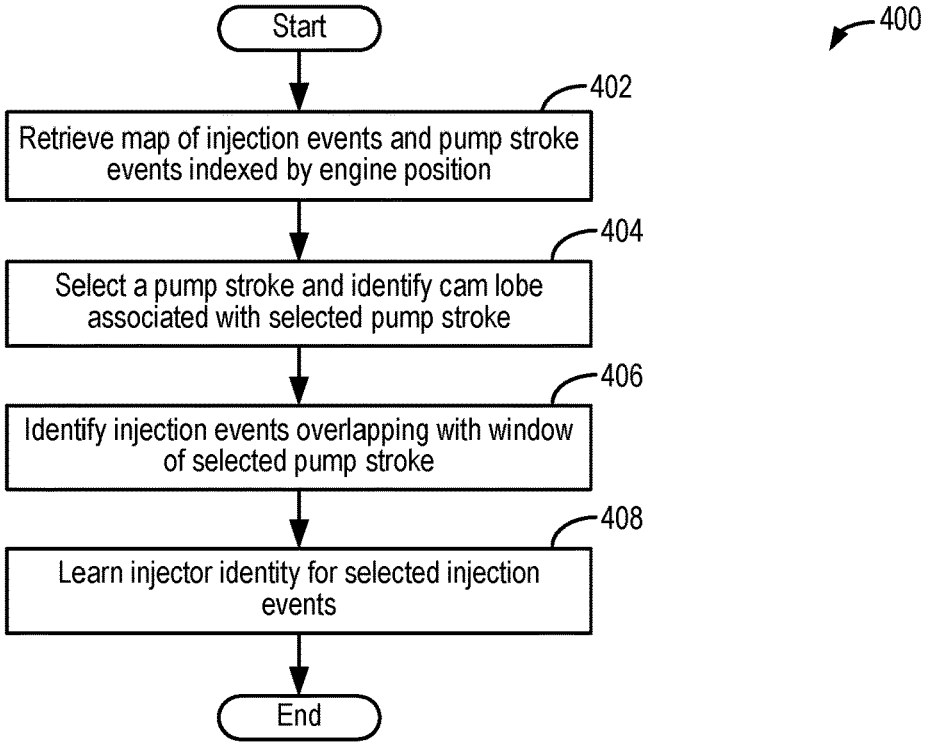
FIG. 4 depicts an example method for selecting a combination of injectors to operate and a cam lobe to disable.
Figure 5:
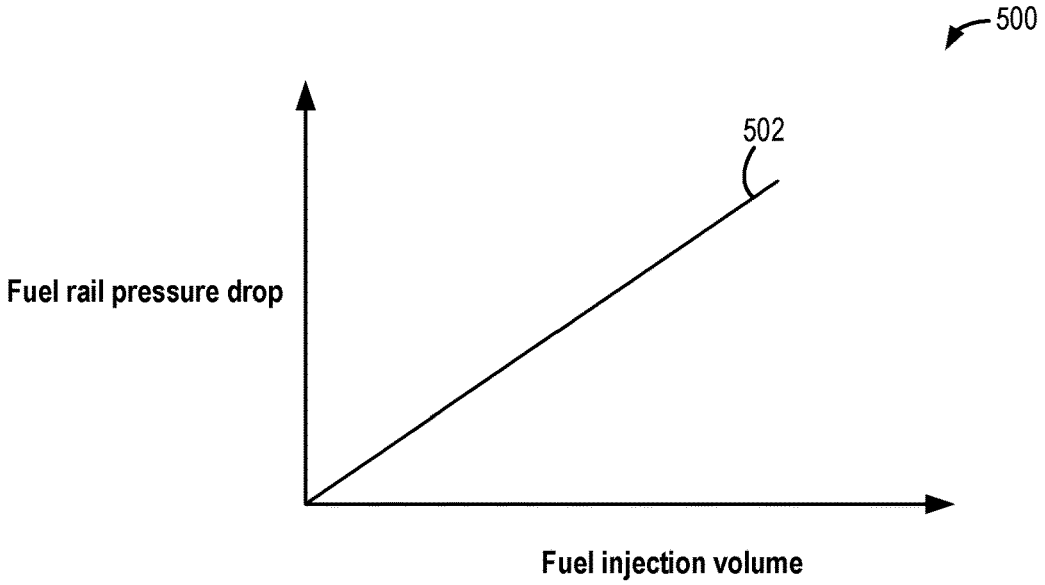
FIG. 5 depicts a graphical relationship between a fuel rail pressure drop and injected fuel quantity at a fuel injection system.

Turning now to FIG. 4, method 400 depicts an example method for selecting a cam lobe to disable during PBIB learning and a group of injectors to operate while the selected cam lobe is disabled. The method enables pressure based injection balancing to be performed on a selected group of injectors with little to no impact on the learning due to the operation of a pump stroke. In one example, the method of FIG. 4 may be performed as part of the method of FIG. 3, such as at 310 (and/or 322).

At 402, the method includes retrieving a map of injection events and pump stroke events stored in the controller's memory and indexed by engine position. The map may have been generated during engine calibration, or during regular engine operation. As such, the map may be specific to the particular engine configuration. For example, the map may differ for a 3 or 6 cylinder engine as compared to a 4 or 8 cylinder engine. The map may also differ for an in-line engine as compared to a V-engine. Furthermore, the map may differ based on the number of cam lobes present on the HPP of the engine, such as based on whether there are 2, 3, or more cam lobes.

Figure 6:
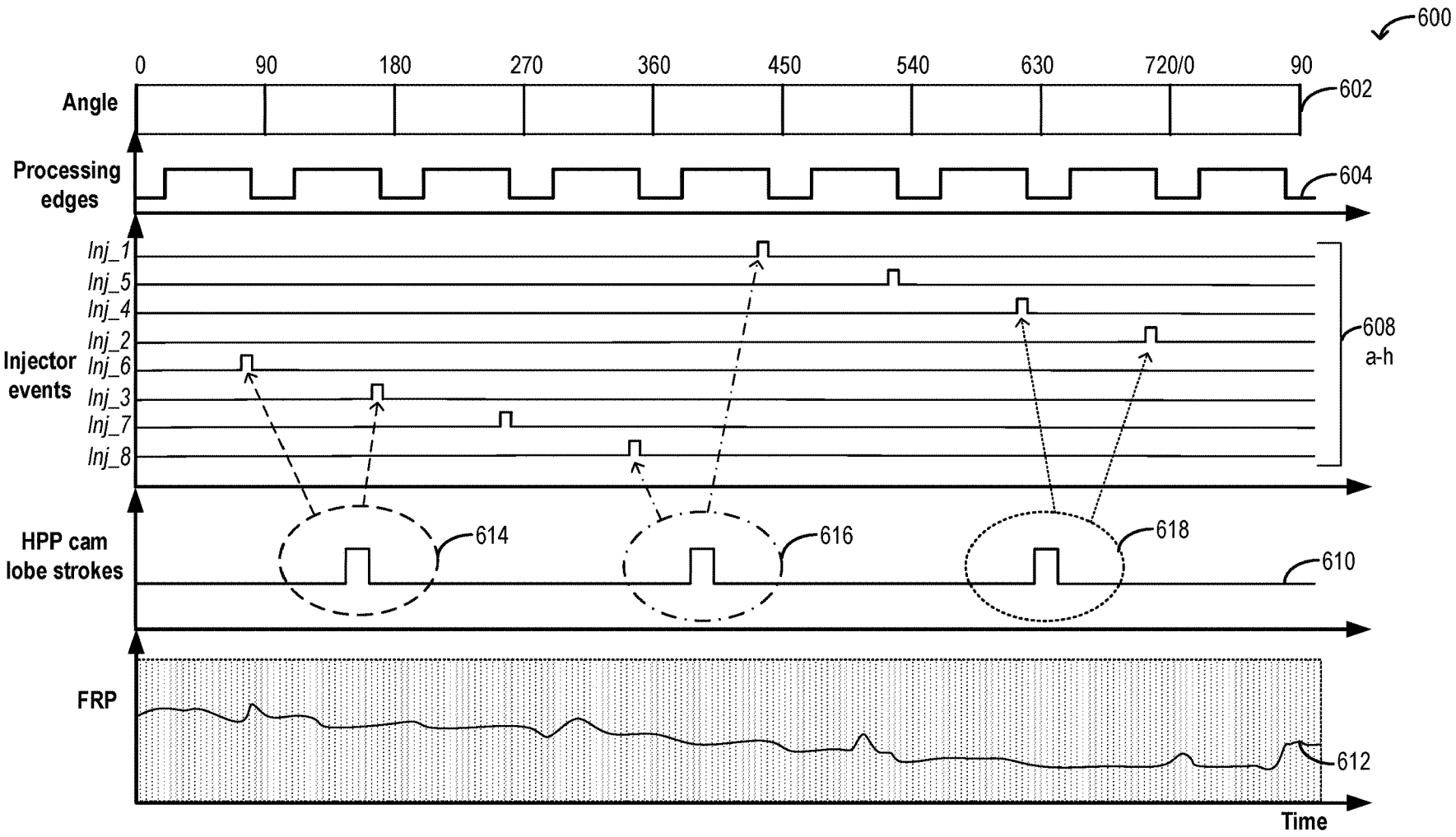
FIG. 6 depicts an example map for selecting a combination of injectors to operate while a given cam lobe is disabled, in accordance with the method of FIGS. 3-4.
Figure 7:
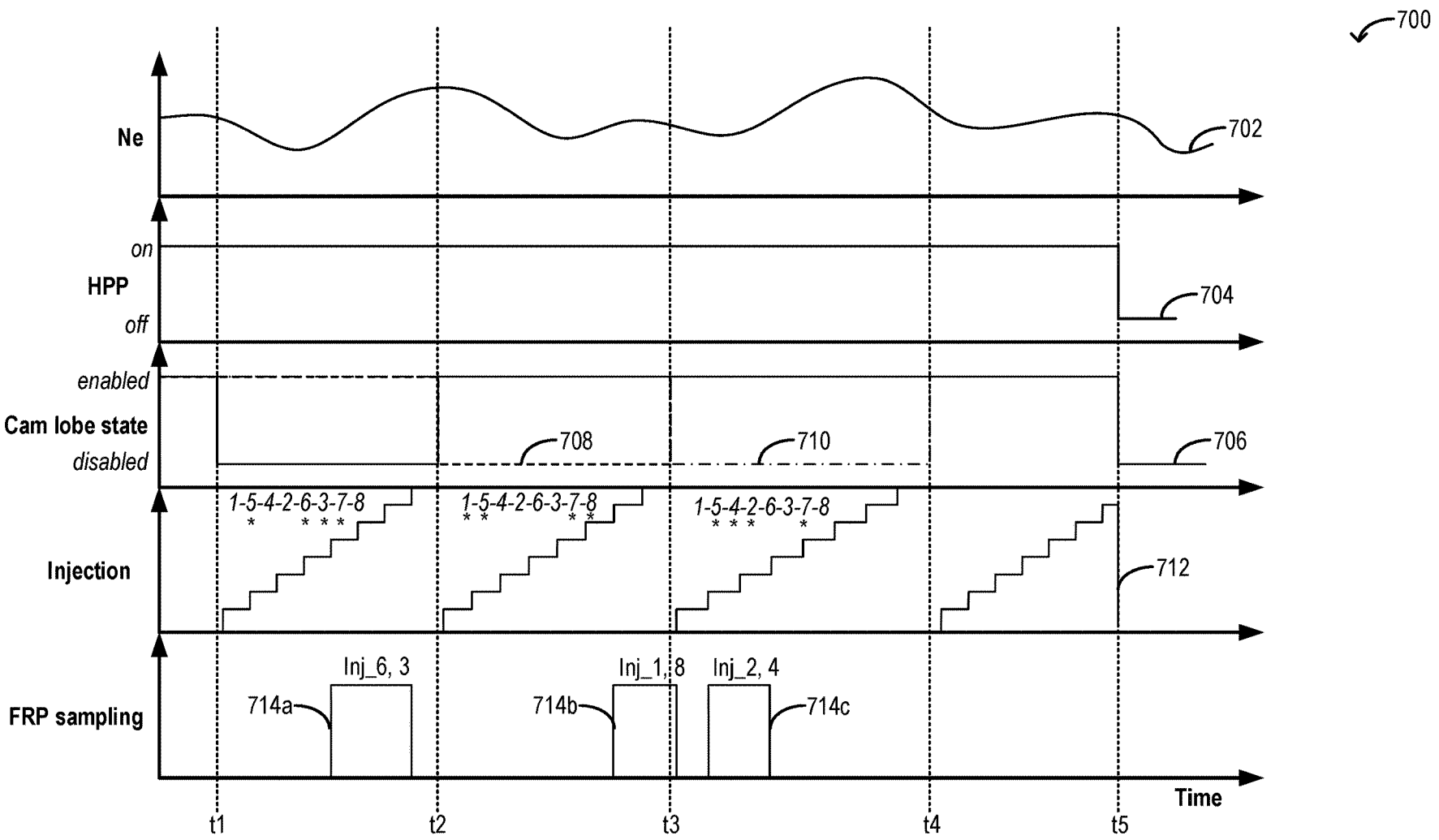
FIG. 7 shows a prophetic example of PBIB learning in accordance with the present disclosure.

One example map is shown with reference to FIG. 6. Specifically, map 600 depicts processing edges of a PIP sensor at plot 604 and the corresponding engine position in terms of crank angle degree at plot 602. Sensed FRP is shown at plot 612, wherein FRP is sensed by a fuel rail pressure sensor. Samples are collected at 1 msec intervals, with each rectangle/box corresponding to a single sample. The operation of each of 8 injectors coupled to 8 different cylinders (labeled 1-8) of an engine is shown at plots 608*a-h*. Pump strokes of each of 3 cam lobes of a high pressure fuel pump are shown at plot 610. In the present example, the order of firing is 1-5-4-2-6-3-7-8. Both injection timing and pump stroke timing are shown relative to each other as well as in relation to engine position, depicted at plot 602.

At 404, the method includes selecting a pump stroke and identifying a corresponding cam lobe on the retrieved map. For example, based on a current engine position (at the time of the PBIB routine), the controller may select a pump stroke that is upcoming (with no other pump stroke in between) and based on the position of the pump stroke relative to the engine position, the controller may identify the corresponding lobe. With reference to the map of FIG. 6, if the upcoming pump stroke is stroke 614, the controller may identify a first cam lobe responsible for pump stroke 614. As such, this first cam lobe may then be selected for selective deactivation. As another example, if the upcoming pump stroke is stroke 616, the controller may identify a second cam lobe responsible for pump stroke 616. This second cam lobe may then be selected for selective deactivation. As a further example, if the upcoming pump stroke is stroke 618, the controller may identify a third cam lobe responsible for pump stroke 618. This third cam lobe may then be selected for selective deactivation.

At 406, the method includes identifying injection events overlapping with a window of operation of the selected cam lobe and its associated pump stroke. In particular, the controller may identify cylinder injectors whose injection events may be impacted (that is, rail pressure may incur interference) due to the pump stroke by the selected cam lobe.

At 408, the method includes learning the identity of the injectors identified as having injection events overlapping with the selected cam lobe. For example, the identity of the injectors may be learned in reference to their cylinder number and firing order. The identified injectors are then mapped as a function of the associated cam lobe. As elaborated at FIG. 3, the identified injectors are then operated in their defined firing order when the associated cam lobe is selectively disabled. The controller may refer to a map that is retrieved from the controller's memory, such as the map of FIG. 6. In one example, the map of FIG. 6 may be generated during engine calibration. The map depicts the inter-injection period and the pump pulse period in relation to each other.

In one example, the controller may keep track of each injector's Start of Injection (SOI) and end of injection (EOI). These are dynamic measures. The inter-injection period is then determined from a delay since EOI (the delay corresponding to a duration since EOI wherein injector ringing occurs and can interfere with/confound the pressure measurement, herein also referred to as the avoid-ringing-period) to SOI of a following injection (that is, an immediately consecutive injection event with no intervening injection events). The DI pump period is also known. Each lobe starts and ends at a defined (but dynamically changing) angle. If the inter-injection period does not have a pump pulse in it, it is a usable measure. By using the preceding and following valid inter-injection period averaged FRP, the controller may compute the pressure drop for that injection event at that injector. By then comparing that drop to the drop of each injector at corresponding injection events, the controller may balance the injectors to provide a common error.

In FIG. 6, the HPP has 3 cam lobes which each operate once in a 720° cycle, that is, each cam lobe induced pressure pulse is separated from a successive pulse by 240°. In the depicted example, the pulses 614, 616, and 618 occur at 145°, 385°, and 625°, respectively.

With reference to FIG. 6, it may be determined that pump stroke 614 is the next upcoming pump stroke at or around 145° CAD, wherein pump stroke 614 is delivered by a first cam lobe of the engine's HPP. Based on the mapping, it is determined that pump stroke 614 interferes with the inter-injection period of injection events at injectors 3 and 6. Therefore the first group of injectors that are operated while the first cam lobe is disabled are injectors Inj_6, and 3. This allows fuel rail pressure sampling to be accurately performed in the inter-injection period between injection events at injectors 6 and 3, allowing for the injector error of injector 6 to be learned and used for a PBIB based injector error learning.

The controller may also include injectors Inj_5 and 7 in the first group of injectors since the pulse 614 does not interfere with these injectors. Thus, the controller may opportunistically also sample the FRP in the inter-injection period between injection events at Inj_3 and Inj_7 to learn the injector error for injector 3.

Then, the first cam lobe is reactivated while a second cam lobe is deactivated removing pump stroke 616 at or around 385° CAD. Based on the mapping, it is determined that pump stroke 616 interferes with the inter-injection period of injection events at injectors 8 and 1. Therefore the second group of injectors that are operated while the second cam lobe is disabled are injectors Inj_1 and 8. This allows fuel rail pressure sampling to be accurately performed in the inter-injection period between injection events at injectors 8 and 1, allowing for the injector error of injector 1 to be learned and used for a PBIB based injector error learning.

The controller may also include injectors Inj_5 and 7 in the second group of injectors since the pulse 616 does not interfere with these injectors. Thus, the controller may opportunistically also sample the FRP in the inter-injection period between injection events at Inj_7 and Inj_8 to learn the injector error for injector 8.

Then, the second cam lobe is reactivated while a third cam lobe is deactivated removing pump stroke 618 at or around 625° CAD. Based on the mapping, it is determined that pump stroke 618 interferes with the inter-injection period of injection events at injectors 4 and 2. Therefore the third group of injectors that are operated while the third cam lobe is disabled are injectors Inj_4, and 2. This allows fuel rail pressure sampling to be accurately performed in the inter-injection period between injection events at injectors 4 and 2, allowing for the injector error of injector 2 to be learned and used for a PBIB based injector error learning.

The controller may also include injectors Inj_5 and 7 in the third group of injectors since the pulse 618 does not interfere with these injectors. Thus, the controller may opportunistically also sample the FRP in the inter-injection period between injection events at Inj_5 and Inj_4 to learn the injector error for injector 4.

To learn any injector, the controller needs the intended fuel mass to be injected (e.g. 5 mg) and the resulting pressure drop across the injector (e.g., 60 kPa). The pressure drop is converted to an actual mass injected (e.g. 5.4 mg). The required mass correction in this example is then −0.4 mg. Multiple instances are filtered or averaged to determine a correction to be introduced into the calculation chain for future operation in that region (defined by FRP and perhaps fuel injection pulse-width). An injector error can be learned anytime its average FRP before and after the injection is not affected by a DI pump stroke. For small injections at lower speeds, injectors 5 and 7 are always in the clear and can be sampled any time.

Turning now to FIG. 7, an example implementation of the method of FIGS. 3-4 is described. Specifically, map 700 depicts engine speed at plot 702, and the operation state of a cam actuated high pressure fuel pump (HPP) at plot 704. The operation state of each of three cam lobes of the HPP is shown at plots 706-710. Injection events from cylinder direct injectors are shown at plot 712. FRP sampling is indicated at plots 712*a-c*. FRP is sampled at a defined rate, such as at 1 sample per millisecond, and each of plots 712*a-c* depicts durations over which FRP samples are kept. During remaining periods, FRP is either not sampled, or samples collected outside the marked area are rejected. In the present example, the order of cylinder firing is 1-5-4-2-6-3-7-8. All plots are shown over time along the x-axis.

Prior to t1, the engine is operating with the HPP enabled and injectors firing. At t1, PBIB learning conditions are met and a PBIB routine is initiated. Therein, while maintaining the HPP enabled, a first cam lobe of the HPP is disabled, as indicated at plot 706 (solid line). At the same time, remaining cam lobes remain active, as indicated by plot 708 (dashed line) and plot 710 (dashed and dotted line). While the first cam lobe is disabled between t1 and t2, all fuel injectors are operated in the firing order. However, the data from only a subset of the injectors is captured. Specifically, FRP is sampled and a pressure drop is learned for the injection events for injectors 5, 6, 3, and 7, as indicated by the asterisks. These are the injectors identified (such as based on map 600 of FIG. 6) to otherwise have interference with the pump stroke of the first cam lobe. The pressure data for remaining injectors is discarded. As a result of the FRP sampling shown at 712*a*, a PBIB based injector error is learned for injectors 6 and 3.

At t2, the first cam lobe is re-enabled and the second cam lobe of the HPP is disabled, as indicated at plot 708. While the second cam lobe is disabled between t2 and t3, all fuel injectors are operated in the firing order. However, the data from only a subset of the injectors is captured. Specifically, FRP is sampled and a pressure drop is learned for the injection events for injectors 1, 5, 7, and 8, as indicated by the asterisks. These are the injectors identified (such as based on map 600 of FIG. 6) to otherwise have interference with the pump stroke of the second cam lobe. The pressure data for remaining injectors is discarded. As a result of the FRP sampling shown at 712*b*, a PBIB based injector error is learned for injectors 1 and 8.

At t3, the second cam lobe is re-enabled and the third cam lobe of the HPP is disabled, as indicated at plot 710. While the second cam lobe is disabled between t3 and t4, all fuel injectors are operated in the firing order. However, the data from only a subset of the injectors is captured. Specifically, FRP is sampled and a pressure drop is learned for the injection events for injectors 5, 4, 2, and 7, as indicated by the asterisks. These are the injectors identified (such as based on map 600 of FIG. 6) to otherwise have interference with the pump stroke of the third cam lobe. The pressure data for remaining injectors is discarded. As a result of the FRP sampling shown at 712*c*, a PBIB based injector error is learned for injectors 2 and 4.

At t4, PBIB learning is completed. Between t4 and t5, a transfer function of each injector is adjusted during a corresponding injection event so as to bring all the injectors towards a common (average) error, thereby balancing the injectors.

At t5, direct injection fueling conditions are not met, such as due to a DFSO or due to a drop in engine load below a threshold at which engine fueling via only port injection is required. Accordingly, the HPP is disabled, all cam lobes are disabled, and direct injector operation is stopped.

In this way, by selectively disabling one cam lobe of a high pressure fuel pump while leaving remaining cam lobes active, a fuel rail pressure may be better maintained during an injector balancing operation as compared to when the pump is fully deactivated. The technical effect of operating a subset of all fuel injectors when a given cam lobe is disabled is that the pressure interference of that cam lobe's pump stroke is reduced or even removed during the PBIB learning for the operated fuel injectors. As a result, a pressure drop across each operated injector is more accurately and reliably learned. By attenuating the effect of an interfering cyclic fuel rail pressure applied on a fuel rail by a pump stroke event, individual injector error may be more accurately determined, without needing to deactivate and reactivate a fuel pump. As a result, a controller may be able to provide better balancing between injectors of all engine cylinders, improving engine fueling accuracy and overall engine performance.

One example method comprises: selectively disabling one cam lobe of a camshaft driven fuel pump while maintaining remaining cam lobes enabled; operating a first set of direct fuel injectors with the one cam lobe disabled; and correlating pressure decrease at each injection event of the first set of injectors with corresponding injector operation. In the preceding example, additionally or optionally, the method further comprises learning a fuel mass error of a corresponding injector of the first set of injectors based on the pressure decrease; and adjusting subsequent engine fueling based on the learned injector error. In any or all of preceding examples, additionally or optionally, the method further comprises retrieving, from a memory of a controller, a map correlating engine injection events and pump stroke events as a function of engine position, and selecting the one cam lobe and the first set of injectors based on the map. In any or all of preceding examples, additionally or optionally, the method further comprises learning, from the retrieved map, a pump stroke timing for each of a plurality of cam lobes of the fuel pump, and one or more injection events overlapping within a window around the pump stroke timing of each of the plurality of cam lobes. In any or all of preceding examples, additionally or optionally, the selectively disabling is responsive to injector balancing conditions being met, the method further comprising, selecting the one cam lobe that is selectively disabled based on the pump stroke timing of the one cam lobe relative to engine position at a time of the injector balancing conditions being met. In any or all of preceding examples, additionally or optionally, the method further comprises, after the operating, reactivating the one cam lobe, disabling another cam lobe, and operating a second set of direct fuel injectors with the another cam lobe disabled. In any or all of preceding examples, additionally or optionally, an identity of injectors in the first set of injectors is non-overlapping with the identity of injectors in the second set of injectors. In any or all of preceding examples, additionally or optionally, an identity of injectors in the first set of injectors is partially-overlapping with the identity of injectors in the second set of injectors. In any or all of preceding examples, additionally or optionally, adjusting subsequent engine fueling includes updating an injector transfer function for each engine fuel injector. In any or all of preceding examples, additionally or optionally, adjusting engine fueling includes updating a transfer function for each fuel injector of the engine based on the learned fuel mass error to provide a common error for each fuel injector.

Another example method for an engine comprises: sequentially disabling one of a plurality of cam lobes of a cam actuated fuel pump; operating a group of fuel injectors with the one cam lobe disabled and remaining cam lobes enabled, the group of fuel injectors selected based on the disabled one cam lobe; and adjusting engine fueling based on individual injector error learned responsive to the operating. In any or all of preceding examples, additionally or optionally, the group of fuel injectors selected based on the disabled one cam lobe includes selecting the group of fuel injectors from all engine fuel injectors responsive to injection timing of the group of fuel injectors overlapping with a pump stroke timing of the disabled one cam lobe. In any or all of preceding examples, additionally or optionally, the sequentially and the operating further includes: operating a first group of fuel injectors while a first of the plurality of cam lobes is disabled and a second of the plurality of cam lobes is enabled; and operating a second group of fuel injectors while the second of the plurality of cam lobes is disabled and the first of the plurality of cam lobes is enabled. In any or all of preceding examples, additionally or optionally, the first group of fuel injectors and the second group of fuel injectors are only partially overlapping. In any or all of preceding examples, additionally or optionally, adjusting subsequent engine fueling includes updating a transfer function for each engine fuel injector.

Another example system comprises: direct fuel injectors coupled to corresponding engine cylinders, the direct injectors receiving fuel from a fuel rail; a cam actuated high pressure fuel pump delivering fuel to the fuel rail, the pump driven by multiple cam lobes; a pressure sensor coupled to the fuel rail; a controller with computer readable instructions stored on non-transitory memory that when executed cause the controller to: operate all the injectors with a first of the multiple cam lobes disabled and remaining cam lobes enabled; learn a pressure drop associated with an injection event at a subset of all the injectors; then operate all the injectors with a second of the multiple cam lobes disabled and remaining cam lobes enabled; and learn a pressure drop associated with the injection event at another subset of all the injectors. In any or all of preceding examples, additionally or optionally, the controller includes further instructions to learn an injector error for each injector of the subset and the another subset of all the injectors based on a corresponding learned pressure drop; and during a subsequent injection event, adjust a transfer function of each injector to bring the learned injector error towards a common error, the common error including an average error of all the learned injector errors. In any or all of preceding examples, additionally or optionally, the controller includes further instructions to: retrieve, from a memory of the controller, a map of injection event timing of each fuel injector and pump stroke timing of each of the multiple cam lobes; and select the subset and the another subset of all the injectors based on the retrieved map. In any or all of preceding examples, additionally or optionally, the controller includes further instructions to group the subset of injectors responsive to injection event timing overlapping with pump stroke timing of the first of the multiple cam lobes; and group the another subset of injectors responsive to injection event timing overlapping with pump stroke timing of the second of the multiple cam lobes. In any or all of preceding examples, additionally or optionally, the controller includes further instructions to: while operating all the injectors with a first of the multiple cam lobes disabled, discard pressure data associated with an injection event at injectors other than the subset of all the injectors.

In a further representation, the engine system is coupled in a hybrid electric vehicle or an autonomous vehicle. In another representation, a method for an engine includes: sampling fuel rail pressure over a number of injection events while operating a cam actuated high pressure direct injection fuel pump with one cam lobe disabled and remaining cam lobes enabled, and learning an injector error based on the sampled fuel rail pressure for a subset of the number of injection events, the subset selected based on injection event timing relative to expected pump stroke timing of the disabled cam lobe.

In yet another representation, a method comprises, during engine calibration, identifying a position of a fuel rail pressure pulse for each cam lobe of a camshaft driven fuel pump relative to an injection event at each cylinder of the engine, and after the calibration, selectively disabling one cam lobe of the camshaft driven fuel pump while maintaining remaining cam lobes enabled; and operating direct fuel injectors for selected cylinders, wherein the fuel rail pressure pulse of the disabled one cam lobe overlaps with an inter-injection period of injection events in the selected cylinders.

In still another representation, a method comprises, during engine calibration, identifying a position of a pressure pulse for each cam lobe of a camshaft driven fuel pump on a direct injection fuel rail relative to an injection event at each cylinder of the engine, and after the calibration, while maintaining all cam lobes enabled and sampling direct fuel rail pressure at a defined sampling rate; transitioning from direct fuel injection to port fuel injection for selected cylinders, wherein the fuel rail pressure pulse of the disabled one cam lobe overlaps with an inter-injection period of injection events in the selected cylinders. In the preceding example, the method further includes correlating a sampled fuel rail pressure decrease at each injection event for all cylinders other than the selected cylinder with corresponding injector operation.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

selectively disabling one cam lobe of a camshaft driven fuel pump while maintaining remaining cam lobes enabled;

operating a first set of direct fuel injectors with the one cam lobe disabled; and correlating pressure decrease at each injection event of the first set of injectors with corresponding injector operation.

2. The method of claim 1, further comprising, learning a fuel mass error of a corresponding injector of the first set of injectors based on the pressure decrease; and adjusting subsequent engine fueling based on the learned injector error.

3. The method of claim 2, wherein adjusting subsequent engine fueling includes updating an injector transfer function for each engine fuel injector.

4. The method of claim 2, wherein adjusting engine fueling includes updating a transfer function for each fuel injector of the engine based on the learned fuel mass error to provide a common error for each fuel injector.

5. The method of claim 1, further comprising, retrieving, from a memory of a controller, a map correlating engine injection event timing and pump stroke event timing to engine position, and selecting the one cam lobe and the first set of injectors based on the retrieved map.

6. The method of claim 5, further comprising:

learning, from the retrieved map, a pump stroke timing for each of a plurality of cam lobes of the fuel pump, and one or more injection events overlapping within a window around the pump stroke timing of each of the plurality of cam lobes.

7. The method of claim 6, wherein the selectively disabling is responsive to injector balancing conditions being met, the method further comprising, selecting the one cam lobe that is selectively disabled based on the pump stroke timing of the one cam lobe relative to engine position at a time of the injector balancing conditions being met.

8. The method of claim 1, further comprising, after the operating, reactivating the one cam lobe, disabling another cam lobe, and operating a second set of direct fuel injectors with the another cam lobe disabled.

9. The method of claim 8, wherein an identity of injectors in the first set of injectors is non-overlapping with the identity of injectors in the second set of injectors.

10. The method of claim 8, wherein an identity of injectors in the first set of injectors is partially-overlapping with the identity of injectors in the second set of injectors.

11. A method for an engine, comprising:

sequentially disabling one of a plurality of cam lobes of a cam actuated fuel pump; operating a group of fuel injectors with the one cam lobe disabled and remaining cam lobes enabled, the group of fuel injectors selected based on the disabled one cam lobe; and adjusting engine fueling based on individual injector error learned responsive to the operating.

12. The method of claim 11, wherein the group of fuel injectors selected based on the disabled one cam lobe includes selecting the group of fuel injectors from all engine fuel injectors responsive to injection timing of the group of fuel injectors overlapping with a pump stroke timing of the disabled one cam lobe.

13. The method of claim 11, wherein the sequentially and the operating further includes:

operating a first group of fuel injectors while a first of the plurality of cam lobes is disabled and a second of the plurality of cam lobes is enabled; and operating a second group of fuel injectors while the second of the plurality of cam lobes is disabled and the first of the plurality of cam lobes is enabled.

14. The method of claim 13, wherein the first group of fuel injectors and the second group of fuel injectors are only partially overlapping.

15. The method of claim 11, wherein adjusting subsequent engine fueling includes updating a transfer function for each engine fuel injector.

16. A system, comprising:

direct fuel injectors coupled to corresponding engine cylinders, the direct injectors receiving fuel from a fuel rail;

a cam actuated high pressure fuel pump delivering fuel to the fuel rail, the pump driven by multiple cam lobes;

a pressure sensor coupled to the fuel rail;

a controller with computer readable instructions stored on non-transitory memory that when executed cause the controller to:

operate all the injectors with a first of the multiple cam lobes disabled and remaining cam lobes enabled;

learn a pressure drop associated with an injection event at a subset of all the injectors;

then operate all the injectors with a second of the multiple cam lobes disabled and remaining cam lobes enabled; and learn a pressure drop associated with the injection event at another subset of all the injectors.

17. The system of claim 16, wherein the controller includes further instructions to:

learn an injector error for each injector of the subset and the another subset of all the injectors based on a corresponding learned pressure drop; and during a subsequent injection event, adjust a transfer function of each injector to bring the learned injector error towards a common error, the common error including an average error of all the learned injector errors.

18. The system of claim 16, wherein the controller includes further instructions to:

retrieve, from a memory of the controller, a map of injection event timing of each fuel injector and pump stroke timing of each of the multiple cam lobes; and select the subset and the another subset of all the injectors based on the retrieved map.

19. The system of claim 18, wherein the controller includes further instructions to:

group the subset of injectors responsive to injection event timing overlapping with pump stroke timing of the first of the multiple cam lobes; and group the another subset of injectors responsive to injection event timing overlapping with pump stroke timing of the second of the multiple cam lobes.

20. The system of claim 16, wherein the controller includes further instructions to:

while operating all the injectors with a first of the multiple cam lobes disabled, discard pressure data associated with an injection event at injectors other than the subset of all the injectors.

* * * * *